US007897250B2

(12) United States Patent
Iwase et al.

(10) Patent No.: US 7,897,250 B2
(45) Date of Patent: Mar. 1, 2011

(54) POLISHING PAD

(75) Inventors: Tadashi Iwase, Tokyo (JP); Tomohiro Iwao, Tokyo (JP)

(73) Assignee: Fujibo Holdings Inc., Tokyo (JP)

( * ) Notice: Subject to any disclaimer, the term of this patent is extended or adjusted under 35 U.S.C. 154(b) by 183 days.

(21) Appl. No.: 12/242,588

(22) Filed: Sep. 30, 2008

(65) Prior Publication Data

US 2009/0093200 A1 Apr. 9, 2009

(30) Foreign Application Priority Data

Oct. 3, 2007 (JP) ..... 2007-260351

(51) Int. Cl.
*B32B 3/26* (2006.01)
*B24D 11/00* (2006.01)

(52) U.S. Cl. ..... 428/315.7; 428/315.5; 451/527

(58) Field of Classification Search ..... 428/315.5, 428/315.7, 314.4, 314.8; 451/527
See application file for complete search history.

(56) References Cited

U.S. PATENT DOCUMENTS 6,899,602 B2 * 5/2005 Fawcett et al. ..... 451/57
7,300,335 B2 * 11/2007 Tajima et al. ..... 451/41
2005/0112354 A1 * 5/2005 Kume et al. ..... 428/304.4

FOREIGN PATENT DOCUMENTS

JP 2005-101541 A 4/2005
JP 2007-160474 A 6/2007

* cited by examiner

*Primary Examiner*—Hai Vo
(74) *Attorney, Agent, or Firm*—Robert Mlotkowski Safran & Cole P.C.

(57) ABSTRACT

The present invention provides a polishing pad whose unevenness in thickness hardly occurs and whose life can be improved. A polishing pad 1 is provided with a polyurethane sheet 2. Foams 3 having lengths of about ½ of the length of the polyurethane sheet 2 in its thickness direction and elongated foams 4 having lengths of at least 70% of the length of the polyurethane sheet 2 in the thickness direction are formed in the polyurethane sheet 2. The foams 3 and the elongated foams 4 are opened by buffing processing so that opened pores 5 and opened pores 6 are formed at a polishing face P, respectively. Regarding the opened pores 5, 6, the total number of opened pores having opened pore diameters falling in a range of from 30 to 50 μm occupies at least 50% of the number of all opened pores. The total number of the opened pores 5, 6 per 1 $mm^2$ of the polishing face P is set in a range of from 50 to 100. An average value of ratio of an opened pore diameter D1 of the opened pore 6 of the elongated foam 4 to an opened pore diameter D2 of the opened pore 6 at a depth position of at least 200 μm from the polishing face P is set in a range of from 0.65 to 0.95.

6 Claims, 2 Drawing Sheets

POLISHING PAD

FIELD OF THE INVENTION

The present invention relates to a polishing pad, and in particular to a polishing pad provided with a soft plastic sheet where opened pores of a foamed body with foams continuously formed by a wet-type film forming method have been formed by removing a surface layer of the foamed body.

DESCRIPTION OF THE RELATED ART

Conventionally, since a material (material to be polished) such as an optical material such as a lens, a plane parallel plate, a reflecting mirror or the like, a silicon wafer, a semiconductor device, a glass substrate for a liquid crystal display or the like is required to have flatness with high accuracy, polishing using a polishing pad is performed to each of these materials. In the silicon wafer or the semiconductor device among them, fineness or multilayer wiring for achieving high density progresses according to a rapid increase in an integration degree of a semiconductor circuit, which brings forth importance of a technique for planarizing a surface (working face) further highly.

As a method for planarizing a surface of a semiconductor device or the like, a chemical mechanical planarization (hereinafter, called "CMP") method is generally used. In the CMP method, slurry that polishing particles have been dispersed in alkaline solution or acidic solution (polishing liquid) is supplied to a working face of a material to be polished and the working face is polished in a state that the working face is being pressed against a polishing pad. The working face is polished according to a mechanical action based upon polishing particles contained in the slurry and a chemical action based upon the alkaline solution or the acidic solution. According to an enhancement in flatness required for the working face, a polishing accuracy required for the CMP method, namely, a performance required for the polishing pad is apt to be elevated.

As the polishing pad, a polishing pad provided with a suede-like soft plastic sheet where opened pores of a foamed body continuously formed by a wet-type film forming method have been formed by removing a surface layer of the foamed body is used. The soft plastic sheet is manufactured by applying resin solution obtained by dissolving soft plastic in water-miscible organic solvent on a sheet-like base material, and then solidifying and (re)forming resin in aqueous solidifying liquid (a wet-type film forming method). A surface layer (a skin layer) where fine holes are densely formed over a thickness of about several micro-meters is formed at the surface of the soft plastic sheet according to the solidifying and forming, and a large number of foams are continuously formed in the soft plastic sheet. Many opened pores are formed on the surface of the soft plastic sheet by removing the skin layer utilizing a buffing processing or the like.

In such a polishing pad, foams formed inside the surface layer take a droplet shape (approximately triangle in section) whose diameter becomes the smaller according to approaching to a surface side of the polishing pad. Therefore, since opened pores formed on the surface are small in a pore diameter so that clogging occurs in the opened pores due to polishing dust or waste slurry, the polishing pad is not satisfactory regarding a life thereof. In order to improve the life, for example, a polishing pad obtained by forming at least 500 fine pores per 1 $mm^2$ and setting surface roughness to a specific range is disclosed. (See JPA-2005-101541.) A polishing pad where a ratio of "opened pore diameter of fine foams" to "distance from an opened pore portion to a deepest portion in the fine foams" is set to from 1/10 to 1/3 is disclosed. (See JPA-2007-160474.)

In the techniques disclosed in JPA-2005-101541 and JPA-2007-160474, however, occurrence of clogging of the opened pores can be suppressed, but since a void ratio (porosity) of the soft plastic sheet is raised due to an increase in the number of foams (opened pores) or an opened pore density, the soft plastic sheet is easily worn away during polishing work. Therefore, since wearing of the soft plastic sheet is increased (the soft plastic sheet is worn away) at portions of the soft plastic sheet where a contacting frequency with a material to be polished is high so that unevenness in thickness of the soft plastic sheet occurs, even polishing work to the material to be polished is prevented. Since the foams formed in the soft plastic sheet take droplet shapes, pore diameters of opened pores become the larger according to progress of wearing, which results in impair of stable working to a material to be polished. In other words, in order to achieve stable polishing work to a material to be polished, it is necessary to replace a polishing pad with a new polishing pad before unevenness occurs in thickness of the polishing pad or pore diameters become large, which results in lowering of a life of the polishing pad. In the technique disclosed in JPA-2007-160474, since the skin layer is removed slightly excessively regarding its thickness, such a problem arises that the thickness of the soft plastic sheet is insufficient, which results in lowering of the life of the soft plastic sheet.

SUMMARY OF THE INVENTION

In view of these circumstances, an object of the present invention is to provide a polishing pad where unevenness in thickness hardly occurs, and stable polishing work can be secured so that a life of the polishing pad can be improved.

In order to achieve the object, there is provided a polishing pad provided with a soft plastic sheet where opened pores of a foamed body with foams continuously formed by a wet-type film forming method are formed by removing a surface layer of the foamed body, wherein a percentage of opened pores having opened pore diameters falling in a range of from 30 μm to 50 μm is at least 50% and the number of opened pores per 1 $mm^2$ on a surface formed with the opened pores falls in a range of from 50 to 100, at least some foams among the foams have lengths of at least 70% of a length of the soft plastic sheet in a thickness direction thereof, and wherein an average value of ratios of diameters of opened pores of the at least some foams on a surface on which the opened pores are formed to diameters of the opened pores at a depth position of at least 200 μm from the surface on which the opened pores of the at least some foams are formed falls in a range of from 0.65 to 0.95.

In the present invention, since the number of opened pores per 1 $mm^2$ of the surface on which the opened pores are formed falls in a range of from 50 to 100, the density of the soft plastic sheet can be raised; since the average value of the ratios of the diameters of the opened pores of the at least some foams having lengths of at least 70% of the length of the soft plastic sheet in the thickness direction thereof to the diameters of the opened pores at the depth position of at least 200 μm from the surface on which the opened pores of the at least some foams are formed falls in a range of from 0.65 to 0.95, a percentage of voids (porosity) contained in a range of the soft plastic sheet from the surface thereof to a depth of 200 μm is hard to change, the range being ordinarily used as a polishing face during polishing work while being worn, so that wearing of the soft plastic sheet can be suppressed and occurrence of unevenness in thickness of the soft plastic sheet can be made hard at an ordinary use time of the polishing pad, and since even if wearing occurs, expansion of the foam diameters can be suppressed, stable polishing work can be secured; and since the percentage of the opened pores having opened pore diameters falling in a range of from 30 μm to 50 μm is at least 50%, occurrence of clogging can be suppressed and excellent polishing performance can be maintained for a long period of time, which results in improvement of a life of the polishing pad.

In the present invention, an apparent density of the soft plastic sheet may be set in a range of from 0.2 g/cm$^3$ to 0.4 g/cm$^3$ and a thickness thereof may be set in a range of from 0.7 mm to 2.0 mm. A percentage where the number of the opened pores at a depth position of at least 200 μm from the surface of the soft plastic sheet on which the opened pores are formed decreases from the number of the opened pores on the surface on which the opened pores are formed may be set to 30% or less. When a diameter of the opened pore in a new state of a soft plastic sheet is represented as A and a diameter of the opened pore when the soft plastic sheet is worn from a surface at which the opened pores are formed in the new product state to the depth position of at least 200 μm is represented as B, a ratio B/A is preferably less than 1.55, more preferably in a range of from 1.05 to 1.54. The opened pores may be formed by performing buffing processing to the soft plastic sheet. The surface of the soft plastic sheet on which the opened pores are formed may be subjected to embossing work.

According to the present invention, since the number of opened pores per 1 mm$^2$ of the surface on which the opened pores are formed falls in a range of from 50 to 100, the density of the soft plastic sheet can be raised; since the average value of the ratios of the diameters of the opened pores of the at least some foams having lengths of at least 70% of the length of the soft plastic sheet in the thickness direction thereof to the diameters of the opened pores at the depth position of at least 200 μm from the surface on which the opened pores of the at least some foams are formed falls in a range of from 0.65 to 0.95, a percentage of voids (porosity) contained in a range of the soft plastic sheet from the surface thereof to a depth of 200 μm is hard to change, the range being ordinarily used as a polishing face during polishing work while being worn, so that wearing of the soft plastic sheet can be suppressed and occurrence of unevenness in thickness of the polishing pad can be made hard at an ordinary use time of the soft plastic sheet, and since even if wearing occurs, expansion of the foam diameters can be suppressed, stable polishing work can be secured; and since the percentage of opened pores having the opened pore diameters falling in a range of from 30 μm to 50 μm is at least 50%, occurrence of clogging can be suppressed and excellent polishing performance can be maintained for a long period of time, which results in improvement of a life of the polishing pad.

DETAILED DESCRIPTION OF THE PREFERRED EMBODIMENTS

An embodiment of a polishing pad according to the present invention will be explained below with reference to the drawings.

(Polishing Pad)

Figure 1:
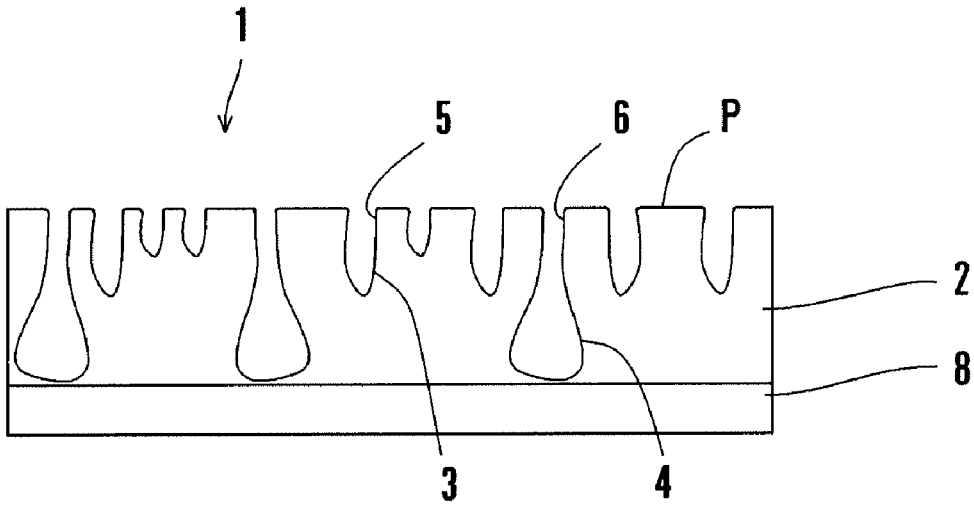
FIG. 1 is a sectional view showing a polishing pad of an embodiment according to the present invention.

As shown in FIG. 1, a polishing pad 1 according to the embodiment is provided with a polyurethane sheet 2 serving as a soft plastic sheet formed of polyurethane resin.

An apparent density of the polyurethane sheet 2 is set in a range of from 0.2 to 0.4 g/cm$^3$ and a thickness thereof is set in a range of from 0.7 to 2.0 mm. The polyurethane sheet 2 has a polishing face P for polishing a material to be polished. Foams 3 having lengths of about a half of a length of the polyurethane sheet 2 in a thickness direction thereof and elongated foams 4 (serving as at least some foams among the forms) having lengths of at least 70% of the polyurethane sheet 2 in the thickness direction and having an approximately section-triangular shape rounded along the thickness direction are approximately evenly formed in the polyurethane sheet 2. The foams 3 and the elongated foams are opened by buffing processing, so that opened pores 5 and opened pores 6 are formed on the polishing face P. In this application, the foams 3 may alternatively be referred to as foam cells 3.

Foams 3 are formed between the elongated foams 4 at a position biased to a side of the polishing face P, and respective foams 3 have variance in length in the thickness direction of the polyurethane sheet 2. Therefore, the foams 3 are approximately evenly formed between the elongated foams 4 approximately evenly formed. The foams 3 and the elongated foams 4 are formed such that the foams diameters thereof on the polishing face P side are smaller than those on the side opposite to the polishing face P. That is, the foams 3 and the foams 4 are reduced in diameters at the polishing face P side. The foams 3 and the foams 4 are caused to communicate with each other via communication holes (not shown) in a network manner.

The opened pores 5 and the opened pores 6 formed on the polishing face P are configured such that opened pores thereof having opened pore diameters falling in a range of from 30 to 50 μm occupy at least 50% of the total number of foams 5 and 6. The number of opened pores 5 and opened pores 6 per 1 mm$^2$ of the polishing face P is set to fall in a range of from 50 to 100. Regarding the total number of opened pores 5 and opened pores 6 (hereinafter, called "total opened pore number"), a percentage where the total number of opened pores at a depth position of at least 200 μm from the polishing face P decreases from the total number of opened pores on the polishing face P is set to 30% or less. That is, the total number of opened pores is maintained in a range of at least 70% of the total number of opened pores before the polishing face P is used for polishing work until the polyurethane sheet 2 is worn by an amount corresponding to a thickness of at least 200 μm due to polishing work.

Figure 2:
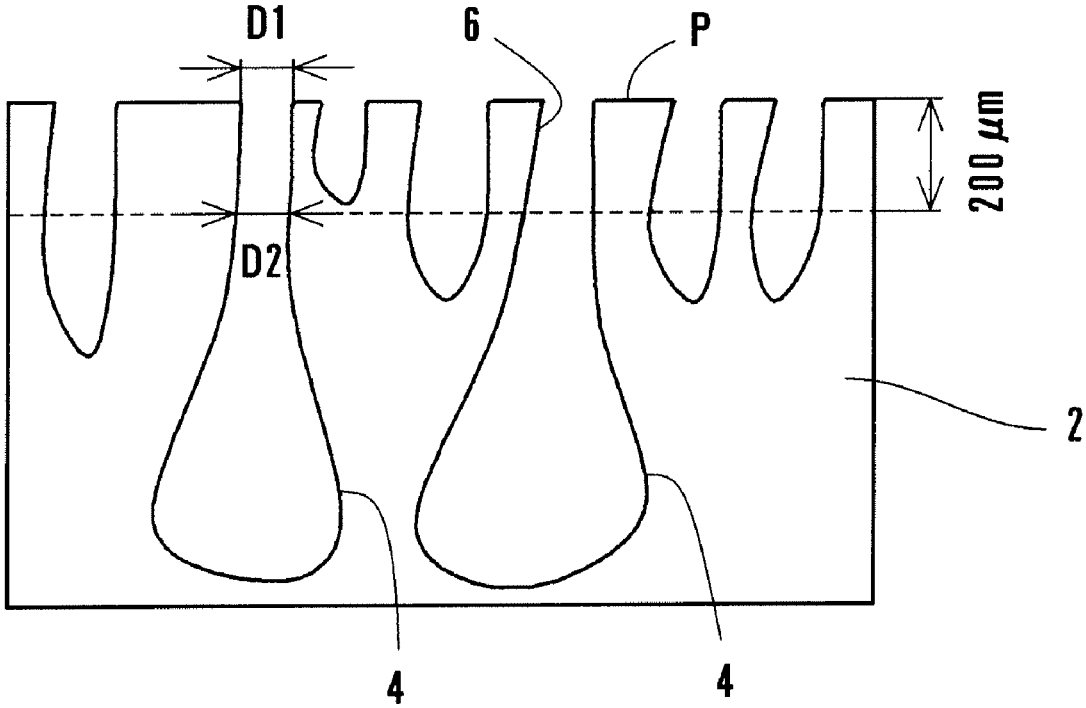
FIG. 2 is a sectional view showing foams and an opened pore diameter in the polishing pad of the embodiment.

As shown in FIG. 2, an average value of ratios of an opened pore diameter D1 of the opened pore 6 of the elongated foam 4 on the polishing face P to an opened pore diameter D2 of the opened pore 6 at a depth position of at least 200 μm from the polishing face P is set to fall in a range of from 0.65 to 0.95. In other words, the opened pore 6 is maintained such that the opened pore diameter thereof is in a range of less than 1.55, namely, 1.05 to 1.54 times the opened pore diameter before the polyurethane sheet 2 is used for polishing work until the polyurethane sheet 2 is worn away by an amount corresponding to the thickness of at least 200 μm.

A double-faced adhesive tape 8 for mounting the polishing pad 1 adheres to the polishing pad 1 to a polishing machine on the opposite side to the polishing face P. The double-faced adhesive tape 8 is obtained by forming adhesive layers (not shown) such as acrylic adhesive on both faces of a base member comprising a flexible film such as a film made of polyethylene telephthalate (hereinafter, abbreviated as "PET"). The double-faced adhesive tape 8 adheres to the polyurethane sheet 2 via an adhesive layer on one face side of the base member and an adhesive layer on the other face side is covered with a release paper (not shown).

(Manufacture of Polishing Pad)

In manufacture of the polishing pad 1, a polyurethane sheet 2 is manufactured by a wet-type film forming method, and the double-faced adhesive tape 8 is caused to adhere to the polyurethane sheet 2. That is, in the wet-type film forming method, polyurethane resin solution obtained by dissolving polyurethane resin in organic solvent is continuously applied to a film formation base and the film formation base is immersed in aqueous solidifying liquid so that polyurethane resin is solidified and formed in a film shape. After washed, the polyurethane resin formed is dried to be formed in a strip-like (elongated) polyurethane sheet 2. The method for manufacturing the polishing pad 1 will be explained below in the order of the respective steps of a preparing step, an applying step, a solidifying and forming step, a washing and drying step, a laminating working step and a cutting and inspecting step.

At the preparing step, polyurethane resin and N,N-dimethylformamide (hereinafter, abbreviated to "PET") which is water-miscible organic solvent which can dissolve the polyurethane resin are mixed so that the polyurethane resin is dissolved. In order to form the elongated foams 4, adjustment organic solvent for foaming adjustment is properly mixed in the mixed liquid obtained. As the polyurethane resin, one selected from resins such as polyester polyurethane, polyether polyurethane, polycarbonate polyurethane or the like is used. The polyurethane resin is dissolved in DMF such that the concentration thereof falls in a range of from 20 to 50%. When the concentration of the polyurethane resin is less than 20%, an apparent density of the polyurethane sheet obtained becomes low, and by contrast, when the concentration of the polyurethane resin is higher than 50%, the density becomes excessively high so that desired pore formation cannot be achieved, which is undesirable. As additive(s), pigment such as carbon black and/or hydrophobic active agent for stabilizing solidification and formation of the polyurethane resin may be added properly at a dissolving time of the polyurethane resin.

As the adjustment organic solvent, one which is less soluble in water than DMF and can be approximately uniformly mixed or dispersed in mixed solution containing the dissolved polyurethane resin without solidifying (gelatinizing) the polyurethane resin dissolved in DMF is used. Specifically, the adjustment organic solvent may be ethyl acetate, isopropyl alcohol, or the like. A blending quantity of the adjustment organic solvent is set according to the opened pore diameters and the number of the foams 3 and the foams 4 at the polishing face P. In this example, since the opened pore diameter and the number of the foams 3, 4 are set in the abovementioned ranges, it is preferable that the blending quantity of adjustment organic solvent is properly adjusted to a range of 45 parts or less to 100 parts of the polyurethane resin solution. When the blending quantity exceeds 45 parts, a solidifying rate becomes extremely low so that the polyurethane sheet 2 having the opened pore diameter and the number of the opened pores described above cannot be obtained. After aggregates or the like are removed by filtering the obtained mixed solution, degassing is performed under vacuum so that the polyurethane resin solution can be obtained.

At the applying step, the polyurethane resin solution prepared at the preparing step is evenly applied to a strip-like film formation base at normal temperature by a knife coater. At this time, by adjusting a clearance between the knife coater and the film formation base, an application thickness (application amount) of the polyurethane resin solution can be adjusted. In this example, in order to set the opened pore diameter, the number of opened pores and the thickness in the abovementioned ranges, it is preferable that the application thickness is properly adjusted in a range of from 1.0 to 3.0 mm. When the application thickness is less than 1.0 mm, the foam diameters at a depth position of at least 200 μm from the surface on which the opened pores are formed tend to become too larger than the foam diameters on the surface, so that the polyurethane sheet 2 set to the abovementioned opened pore diameter and the like cannot be obtained. On the other hand, when the application thickness exceeds 3.0 mm, dripping or application unevenness occurs easily before the polyurethane resin solution is immersed in aqueous solidifying liquid and a solidifying rate becomes extremely slow, so that the polyurethane sheet 2 set to the abovementioned opened pore diameter and the like cannot be obtained. As the film formation base, a flexible film, a nonwoven fabric, a woven fabric or the like can be used. When the nonwoven fabric or the woven fabric is used as the film formation base, pretreatment (filling) for immersing the film formation base in the water, DMF aqueous solution (mixed solution of DMF and water) or the like in advance is performed in order to suppress permeation of polyurethane resin solution into the film formation base during application of the polyurethane resin solution. When a flexible film made of PET or the like is used as the film formation base, since the film formation base does not have permeability to liquid, the pretreatment is not required. In this example, a case where the film made of PET is used as the film formation base will be explained below.

At the solidifying and forming step, the film formation base applied with polyurethane resin solution at the applying step is immersed in solidifying solution containing water which is poor solvent to polyurethane resin as a main component. A skin layer (a surface layer) with a thickness of about several micro-meters is first formed at a surface side of the polyurethane resin solution applied. Polyurethane resin is solidified and formed on one face of the film formation base in a sheet shape according to a progress in substitution of solidifying solution with DMF and adjustment organic solution. That is, DMF and adjustment organic solvent are desolvated from the polyurethane resin solution and the solidifying solution is replaced with the DMF and adjustment organic solvent, so that the foams 3 and foams 4 are formed inside the skin layer (in polyurethane resin) and communication holes (not shown) for causing the foams 3 and the foams 4 to communicate with each other in a network manner are formed inside the skin layer. Since the film made of PET which is the film formation base does not allow permeation of water, desolvation occurs on the skin layer side of the polyurethane resin solution, and the elongated foams 4 formed on the film formation base side becomes larger than that formed at the skin layer side. At this time, when the adjustment organic solvent is added in the polyurethane resin or an application thickness of the polyurethane resin solution is made large, a progress in substitution of DMF and adjustment organic solvent with the solidifying solution in the polyurethane resin solution is delayed. When the temperature of solidifying solution is raised, formation of skin layer is accelerated so that a progress in substitution of DMF and adjustment organic solvent with the solidifying solution in the polyurethane resin solution is further delayed. In this example, in order to set the opened pore diameter, the number of opened pores and the apparent density to the abovementioned ranges, the temperature of the solidifying solution is properly adjusted preferably in a range of from 20 to 50 deg. Cel., more preferably in a range of from 25 to 40 deg. Cel. When the temperature of the solidifying solution is less than 20 deg. Cel., the apparent density is low, the number of opened pores increases and the opened pore diameter becomes small, which is undesirable. Especially, when the application thickness is set to 1.0 mm or more, if the temperature of the solidifying solution is excessively low, the film formation base is brought into the drying step (described later) being in a state that the polyurethane resin is solidified insufficiently in the solidifying and forming step, which is undesirable. On the contrary, when the temperature of the solidifying solution exceeds 50 deg. Cel., formation of the skin layer is excessively accelerated, a progress in substitution of DMF and adjustment organic solvent with solidifying solution in polyurethane resin solution is excessively delayed, the polyurethane sheet 2 set to the abovementioned opened pore diameter or the like cannot be obtained and a working environment deteriorates, which is also undesirable. Incidentally, the temperature of the solidifying solution shows the temperature of the solidifying solution which first contacts with the polyurethane resin solution, and when a plurality of solidifying solution vessels are provided, the temperatures of solidifying solutions in a second vessel and the vessels subsequent thereto are not limited to specific ones but it is preferable that the temperatures are set in a range of from 40 to 80 deg. Cel.

Here, formation of the foams 3 and foams 4 will be explained. Since the adjustment organic solvent is blended in the polyurethane resin solution and solubility of the adjustment organic solvent to water is smaller than that of DMF, elution of the adjustment organic solvent into water (solidifying solution) is delayed as compared with DMF. Since the adjustment organic solvent is added in the polyurethane resin solution, the amount of DMF is reduced corresponding to the addition amount of the adjustment organic solvent. Therefore, since a substitution rate (speed) of DMF and adjustment organic solvent with solidifying solution becomes slow, the elongated foams 4 are formed approximately evenly in an inner side (in the polyurethane resin) from the skin layer in a dispersing manner. Since desolvation occurs through fine holes of the skin layer, the foams 3 are formed in an elongated shape between the elongated foams 4 at a position biased to the skin layer side.

At the washing and drying step, the polyurethane resin (hereinafter, called "film forming resin") solidified and formed at the solidifying and forming step is peeled off from the film formation base and the film forming resin is washed in washing solution such as water so that DMF remaining in the film forming resin is removed. After washed, the film forming resin is dried in a cylinder drier. The cylinder drier is provided with a cylinder including a heat source therein. The film forming resin is caused to pass along a peripheral face of the cylinder of the cylinder drier to be dried. After dried, the film forming resin is wound in a roll shape.

Buffing processing is performed to the film forming resin after dried at its skin layer side. In the buffing processing, an approximately flat face of a pressure contacting jig is brought in pressure-contact with a face of the film forming resin at the side opposite to the skin layer and the buffing processing is performed to the face of the film forming resin at the side of the skin layer. In this example, since the film forming resin formed continuously is strip-shaped, the skin layer is continuously subjected to the buffing processing while the face of the film forming resin opposite to the skin layer is brought in pressure-contact with a pressure-contacting roller. Thereby, as shown in FIG. 1, the skin layer is removed and the opened pores 5 and opened pores 6 appear at the polishing face P of the polyurethane sheet 2. By performing the buffing processing, the thickness of the polyurethane sheet 2 is made approximately even. In the polyurethane sheet 2 obtained here, a hardness thereof is in a range of from 15 to 30 deg. in Shore A hardness, a compressibility is in a range of from 5 to 20%, and a compressive elastic modulus is in a range of from 85 to 98%. The hardness, the compressibility and the compressive elastic modulus are not limited to the specific ones, but when the polyurethane sheet 2 is excessively soft, it is difficult to perform stable polishing work to a material to be polished and when the polyurethane sheet 2 is excessively hard, scratch easily occurs on a material to be polished, so that it is preferable that the hardness, the compressibility and the compressive elastic modulus are preferably set in the abovementioned ranges. These numerical values can be adjusted according to the kind and the concentration of polyurethane resin to be used, the blending amount of the adjustment organic solvent and the like.

At the laminating working step, the double-faced adhesive tape 8 is cause to adhere to a face of the polyurethane sheet 2 after the buffing processing which is positioned at the side opposite to the polishing face P. After embossing work is applied to the polishing face P, the polyurethane sheet 2 is cut in a desired shape such as a circular shape at the cutting and inspecting step. A pattern obtained by the embossing work is not limited to a specific one and any pattern which makes movement of slurry during polishing work smooth can be adopted. Inspection such as confirming that neither dirt nor foreign matter adheres to the polyurethane sheet 2 is carried out to complete the polishing pad 1.

When polishing work to a material to be polished is performed using the polishing pad 1 obtained, the release paper of the double-faced adhesive tape 8 is peeled off and the polishing pad 1 is caused to adhere to a polishing surface plate of a polishing machine. Polishing liquid containing polishing particles is supplied between a face to be polished of the material to be polished and the polishing pad 1, and the face to be polished of the material to be polished is polished by rotating the polishing surface plate while pressuring the material to be polished and the polishing face P against each other.

(Effects)

Next, effects of the polishing pad 1 according to the embodiment or the like will be explained.

Figure 3:
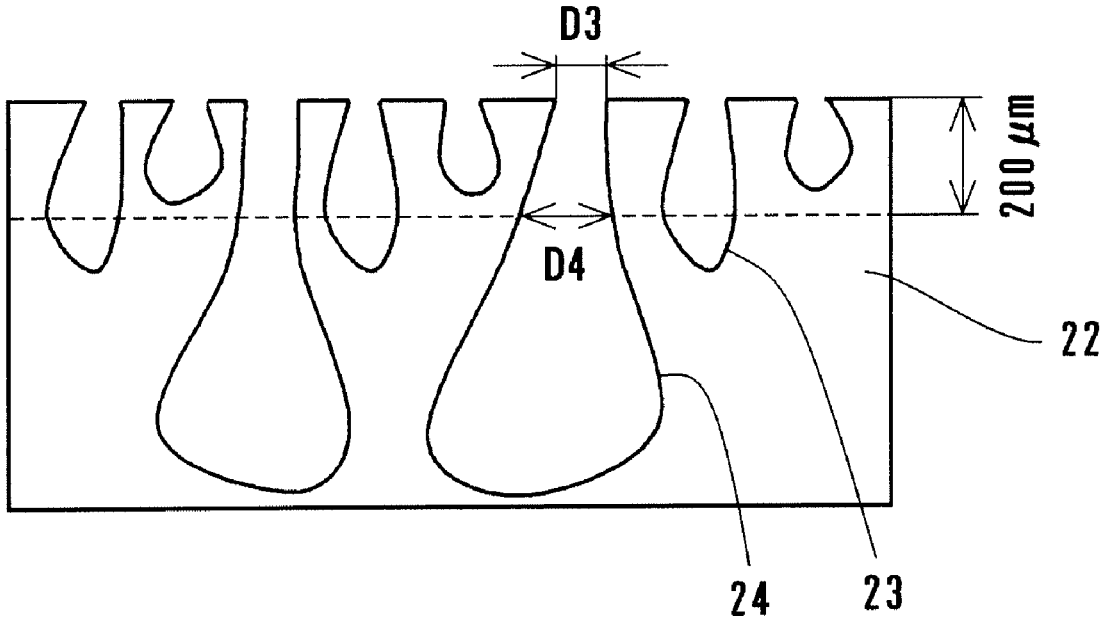
FIG. 3 is a sectional view showing foams and an opened pore diameter in a conventional polishing pad.

In a polyurethane sheet 22 manufactured by a conventional wet-type film forming method, as shown in FIG. 3, small foams 23 having an approximately half length of the polyurethane sheet 22 in a thickness direction thereof and large foams 24 having a length approximately equal to the whole length of the polyurethane sheet 22 in the thickness direction are formed approximately evenly. The larger a distance from the surface becomes, the larger the diameters of the foams 23, 24 become. Especially, in the large foams 24, an average value of ratios of an opened pore diameter D3 at the surface of the polyurethane sheet 22 to an opened pore diameter D4 at a depth position of 200 μm from the surface falls in a range of about 0.6 or less. Since foam diameters of the small foam 23 and the large foam 24 increase largely, a ratio where the total number of opened pores at the depth position of 200 μm from the surface decreases from the total number of opened pores on the surface exceeds 30%. Further, in the polyurethane sheet 22, the opened pores increase in number such as 200 to 500/mm$^2$. When polishing work is performed utilizing a polishing pad using such a polyurethane sheet, the pore diameters of the small foams 23 and the large foams 24 become large in a relatively short time according to progress of wearing of the polyurethane sheet due to continuation of the polishing work, so that polishing characteristic changes, which results in difficulty of adjustment of polishing conditions. Since the foams (opened pores) increase in number, the porosity of the polyurethane sheet increases and the apparent density becomes small, wearing easily occurs during polishing work and unevenness in thickness of the polyurethane sheet occurs, so that even polishing work to the material to be polished is reduced. In order to secure stable polishing work to a material to be polished, it is necessary to replace the polishing pad before the pore diameters become large or before unevenness in thickness occurs. Thus, the conventional polishing pad is poor in life. The polishing pad 1 according to the embodiment can solve these problems.

In the polishing pad 1 according to the embodiment, the elongated foams 4 having the length of at least 70% of the length of the polyurethane sheet 2 in the thickness direction are formed in the polyurethane sheet 2, where the average value of ratios of the opened pore diameter D1 of the elongated foam 4 at the polishing face P to the opened pore diameter D2 of the elongated foam 4 at the depth position of at least 200 μm from the polishing face P is set in a range of from 0.65 to 0.95 (see FIG. 2). Therefore, even if the polyurethane sheet 2 is worn during polishing work, expansion of the opened pore diameter is suppressed so that a ratio of occupation of opened pores to the polishing face P hardly changes. Thereby, since reservation and supply of slurry during polishing work is stabilized, a material to be polished can be polished evenly for a long period of time and the life of the polishing pad 1 can be improved.

In the polishing pad 1 according to the embodiment, the number of opened pores per 1 mm$^2$ of the polishing face P is set in a range of from 50 to 100. Therefore, since the number of opened pores is less than that in the conventional polyurethane sheet 22, the apparent density of the polyurethane sheet 2 can be increased. Thereby, since wearing during polishing work is suppressed, it can be made hard to cause unevenness in thickness. Accordingly, even if polishing work is repeated, even polishing work to the material to be polished can be secured and the life of the polishing pad 1 can be improved.

Further, in the polishing pad 1 according to the embodiment, the number of opened pores having opened pore diameters falling in a range of from 30 to 50 μm occupies at least 50% of the total number of the opened pores 5 and opened pores 6. Therefore, since a percentage of opened pores having small diameters less than 30 μm decreases, clogging due to slurry supplied during polishing work and polishing sludge can be suppressed. Thereby, since the polishing work can be continued, polishing performance can be exerted for a long period of time.

Furthermore, in the polishing pad 1 according to the embodiment, a percentage where the total number of opened pores (the total number of the opened pores 5 and opened pores 6) at the depth position of at least 200 μm from the polishing face P decreases from the total number of opened pores at the polishing face P is set in a range of 30% or less. Therefore, at least 70% of the total number of opened pores before the polishing pad 1 is used can be maintained until the polyurethane sheet 2 is worn by an amount corresponding to the thickness of at least 200 μm. Thereby, since high polishing performance is exerted without causing lowering of the polishing performance, a long life of the polishing pad 1 can be achieved.

Moreover, in the polishing pad 1 according to the embodiment, the apparent density of the polyurethane sheet 2 is set in a range of from 0.2 to 0.4 g/cm$^3$. Therefore, since the apparent density of the polyurethane sheet 2 is higher than that of the conventional polyurethane sheet 22, occurrence of wearing can be made hard or suppressed. Since the thickness of the polyurethane sheet 2 is set in a range of from 0.7 to 2.0 mm, a thickness required for polishing work can be secured. Accordingly, since polishing work can be performed for a long period of time, the life of the polishing pad 1 can be improved.

In the polishing pad 1 according to the embodiment, since the foams 3 and the foams 4 are in communication with each other via communication holes, polishing solution is moved between the foams 3 and the foams 4 via the communication holes so that polishing solution can be supplied between the material to be polished and the polishing pad 1 approximately evenly. Thereby, since a face to be worked of the material to be polished is polished approximately evenly, even polishing work to the face to be worked can be made possible so that flatness of the face to be worked can be improved. In the polishing pad 1 according to the embodiment, the double-faced adhesive tape 8 having the base member of a film made of PET is caused to adhere to the face of the polyurethane sheet 2 opposite to the polishing face P. Therefore, since the soft polyurethane sheet 2 is supported by the base member of the double-faced adhesive tape 8, handling of the polishing pad 1 during conveyance thereof or at a mounting time to a polishing machine can be made easy.

In the embodiment, incidentally, the example that adjustment of the polyurethane resin solution concentration, mixing of adjustment organic solvent, adjustment of the application thickness, and adjustment of the solidifying solution temperature are performed in order to form elongated foams 4 in the polyurethane sheet 2 has been shown, but the present invention is not limited to this example. Wet-type film forming conditions such as raising the apparent density of the polyurethane sheet 2, namely, conditions such that delaying desolvation at the solidifying and forming step can be set in order to set the opened pore diameter of the elongated foams 4 and the total number of opened pores in the abovementioned ranges. Besides the above, the conditions may include preparation of a solidifying solution composition for delaying desolvation, blending additive for delaying desolvation or the like.

In the embodiment, the example where the skin layer is removed to form opened pores by performing buffing processing to the film forming resin after wet-type film formation has been shown, but the present invention is not limited to this example. As the method for forming opened pores at the polishing face P, any method by which the skin layer can be removed can be adopted. For example, slicing processing may be performed for removing the skin layer. When the slicing processing is utilized, for example, an approximately flat polyurethane sheet 2 from which the skin layer has been removed can be obtained, for example, by performing the slicing processing while imparting tension when a fact that the film forming resin is soft and has elasticity is taken into consideration.

Further, in the embodiment, the example where a film made of PET is used as the film formation base at a wet-type film forming time has been shown, but the present invention is not limited to this example. For example, a nonwoven fabric or a woven fabric may be used as the film formation base. In this case, since it is difficult to peel off the solidified and formed polyurethane resin from the film formation base, after the polyurethane resin is washed and dried as it is without performing peeling-off, the double-face adhesive tape 8 may be caused to adhere to a face of the base member opposite to the polyurethane resin. The example where the double-faced adhesive tape 8 is caused to adhere to a face of the polyurethane sheet 2 opposite to the polishing face P has been shown, but such a configuration can be adopted that a supporting member supporting the polyurethane sheet 2 is caused to adhere between the polyurethane sheet 2 and the double-faced adhesive tape 8. By adopting such a configuration, conveying or handling of the polishing pad 1 can be made further easy.

Further, in the embodiment, the example where polyurethane resin such as polyester polyurethane, polyether polyurethane or polycarbonate polyurethane is used as material for polyurethane sheet 2 has been shown, but the present invention is not limited to this example. For example, polyester resin or the like may be used. In a case that the polyurethane resin is used, a sheet having a foamed structure where the foams 3 and the elongated foams 4 have been formed can be formed easily by a wet-type film forming method. Further, in the embodiment, the example where the knife coater is used for application of polyurethane resin solution has been shown, but, for example, a reverse coater, a roll coater or the like can be used. Any coater which allows even thickness application to a film formation base can be used. Further, in the embodiment, the example where the cylinder drier is used for drying polyurethane resin has been shown, but the present invention is not limited to this example, and a hot air drier or the like can be used, for example.

EXAMPLE

Example of the polishing pad 1 manufactured according to the embodiment will be explained below. Incidentally, a polishing pad of Comparative Example manufactured for comparison will also be described.

Example 1

In Example 1, polyester MDI (diphenylmethane diisocyanate) polyurethane resin was used as the polyurethane resin. After 45 parts of DMF which is solvent, 40 parts of DMF dispersion liquid containing carbon black which is pigment in an amount of 30%, and 2 parts of hydrophobic active agent which is film forming stabilizer were mixed to 100 parts of DMF solution of the polyurethane resin to dissolve the polyurethane resin, 45 parts of ethyl acetate which is adjustment organic solvent was added to the dissolved polyurethane resin to prepare polyurethane resin solution. An application thickness and the temperature of solidifying liquid were set to 1.30 mm and 30 deg. Cel. at an application time of the polyurethane resin solution to the film formation base. A polishing pad 1 of Example 1 was manufactured by performing buffing processing to the skin layer side of the film forming resin so as to achieve buffing processing amount of 0.14 mm using sand paper of buff count No. 180, and then causing the double-faced adhesive tape 8 to adhere to the polyurethane sheet 2.

Comparative Example 1

Comparative Example 1 was prepared in the same manner as Example 1 except that the application thickness was set to 0.93 mm and the temperature of solidifying liquid was set to 18 deg. Cel. Accordingly, a polishing pad of Comparative Example 1 was a conventional polishing pad (see FIG. 3).

(Evaluation)

Regarding the polishing pads of Example 1 and Comparative Example 1, the thickness sizes and apparent densities of the polyurethane sheets 2 and 22 were measured. Regarding measurement of the thickness sizes, measurements were performed using a dial gauge (the minimum scale: 0.01 mm) while applying a weight of 100 g/cm$^2$ thereto. The polyurethane sheets 2 and 22 having a horizontal size of 1 m and a vertical size of 1 m were read down to 1/10 of the minimum scale (0.001 mm) at 10 cm pitch vertically and horizontally so that average values of the thickness sizes were obtained. Regarding measurements of the apparent densities, a weight per unit area was measured and the apparent densities were calculated using the measurement results of the thickness sizes.

The number of opened pores 5 and opened pores 6 was observed by magnifying a range of about 4.6 mm square to 50 times using a microscope (VH-6300 manufactured by KEYENCE) and the total number of opened pores per 1 mm$^2$ of the polishing face P was calculated by applying image processing software (Image Analyzer V20LBA Ver. 1.3) to the image obtained. The opened pore diameters of the opened pores 5 and the opened pores 6 were observed by magnifying a range of about 1.5 mm square to 150 times using the microscope (VH-6300 manufactured by KEYENCE) and a percentage (opened pore percentage) of the number of opened pores having opened pore diameters falling in a range of from 30 to 50 μm at the polishing face P to the total number of opened pores was calculated by applying image processing software (Image Analyzer V20LBA Ver. 1.3) to the image obtained.

Further, from a sectional photograph (scanning electron microscope) of the polyurethane sheet 2 formed in a film shape, the number of opened pores per 1 mm at the polishing face P and the number of opened pores (the number of foams) per 1 mm of a plane spreading along the polishing face P at a depth position of 200 μm from the polishing face P in a thickness direction of the polyurethane sheet 2 were measured and a percentage (an opened pore reduction percentage) where the total number of opened pores at the depth position of 200 μm decreases from the total number of opened pores at the polishing face P was calculated. Regarding the opened pore diameter of the elongated foams 4, the opened pore diameter D1 at the polishing face P and the opened pore diameter D2 at the depth position of 200 μm were measured from the same photograph and an average value of percentages (opened pore diameter percentages) of the opened pore diameter D1 to the opened pore diameter D2 was calculated. Regarding Comparative Example 1, an average value of percentages of the opened pore diameter D3 to the opened pore diameter D4 was calculated in the same manner as the above. The results of the thickness size, the apparent density, the opened pore percentage, the total number of opened pores, the opened pore reduction percentage, and the opened pore diameter ratio are shown in the following TABLE 1.

TABLE 1

| | Thickness (mm) | Apparent Density (g/cm$^3$) | Opened Pore Percentage (%) |
|---|---|---|---|
| Example 1 | 0.98 | 0.243 | 69.9 |
| Comparative Example 1 | 0.68 | 0.233 | 48.0 |

TABLE 1-continued

| | Total Number of Opened Pores (number/mm$^2$) | Opened Pore Reduction Percentage (%) | Opened Pore Diameter Ratio |
|---|---|---|---|
| Example 1 | 85 | 27.2 | 0.695 |
| Comparative Example 1 | 110 | 36.7 | 0.509 |

As shown in TABLE 1, in the polishing pad 1 of Example 1 using the polyurethane sheet 2 solidified and formed by setting the application thickness and the temperature of solidifying liquid to 1.30 mm and 30 deg. Cel. to delay the solidifying rate, the opened pore percentage was 69.9%, namely, more than 50%, and the total number of opened pores was 85/mm$^2$, namely, in a range of from 50 to 100/mm$^2$. As a result, the apparent density was 0.243 g/cm$^3$, namely, in a range of from 0.2 to 0.4 g/cm$^3$. Therefore, since wearing during polishing work is suppressed and unevenness in thickness hardly occurs, it can be expected to improve flatness of a material to be polished. Since the opened pore reduction percentage is suppressed to 27.2%, namely, equal to or less than 30%, even if the polyurethane sheet 2 is worn during polishing work by an amount corresponding to the thickness of 200 μm, the total number of opened pores is maintained in a range of 70% or more, it can be expected to suppress lowering of a polishing efficiency to secure flatness of the material to be polished. Besides, since the opened pore diameter ratio was 0.695, even if polishing work is continued, the opened pore diameter does not change so much, so that flatness of the material to be polished can be secured and improvement of a life of the polyurethane sheet 2 can be expected.

By contrast, in the polishing pad of Comparative Example 1 using a polyurethane sheet solidified and formed by setting the application thickness and the temperature of solidifying liquid to 0.98 mm and 18 deg. Cel. without delaying a solidifying rate, the opened pore percentage showing the percentage of opened pores having opened pore diameters falling in a range of from 30 to 50 μm was 48.0% and the percentage of opened pores having opened pore diameters of less than 30 μm was more than that in Example 1. The total number of opened pores was 110/mm$^2$, so that the apparent density was 0.233 g/cm$^3$ smaller than the total number of opened pores in Example 1. From this, it is considered that the polishing pad of Comparative Example 1 is worn more easily than the polishing pad of Example 1 and the former generates unevenness in thickness more easily than the latter during use for polishing work. It is also considered that, since the opened pore reduction percentage of Comparative Example 1 was 36.7%, when wearing progresses up to about 200 μm during polishing work, the number of opened pores largely decreases to lower the polishing efficiency. It is further considered that, since the opened pore diameter ratio Comparative Example 1 was 0.509, the opened pore diameter becomes the larger according to continuation of polishing work and the polishing characteristic changes so that it is made difficult to adjust the polishing condition and flatness of a material to be polished is reduced.

INDUSTRIAL APPLICABILITY

Since the present invention provides a polishing pad whose unevenness in thickness hardly occurs and whose life can be improved, it contributes to manufacture and sale of a polishing pad so that the present invention has industrial applicability.

What is claimed is:

1. A polishing pad comprising a soft urethane foam sheet having foam cells with opened pores formed on a surface of the foam sheet, the opened pores being formed by opening the foam cells by a buffing or slicing process, wherein a percentage of said opened pores having opened pore diameters falling in a range of from between about 30 μm to 50 μm is at least 50% and the number of opened pores per 1 mm$^2$ on said surface falls in a range of between about 50 to 100, and at least some of said foam cells have lengths of at least about 70% of a length of the soft urethane sheet in a thickness direction thereof, and wherein an average value of a ratio of diameters of opened pores of the foam cells on the surface on which the opened pores are formed to diameters of the opened pores at a depth position of at least about 200 μm from the surface on which the opened pores are formed falls in a range of from between about 0.65 to 0.95.

2. The polishing pad according to claim 1, wherein an apparent density of the soft urethane sheet is in a range of from between about 0.2 g/cm$^3$ to 0.4 g/cm$^3$, and wherein a thickness thereof is in a range of from between about 0.7 mm to 2.0 mm.

3. The polishing pad according to claim 1, wherein the soft urethane sheet is configured such that a percentage of the number of opened pores at a depth position of at least 200 μm from the surface of the foam sheet decreases from the number of the opened pores on the surface by 30% or less.

4. The polishing pad according to claim 1, wherein, when a diameter of an opened pore in a new product state of the soft urethane sheet is represented as A and a diameter of an opened pore when the soft plastic sheet is worn from the surface to a depth position of at least 200 μm is represented as B, a ratio B/A is less than 1.55.

5. The polishing pad according to claim 4, wherein the ratio B/A is in a range of from between about 1.05 to 1.54.

6. The polishing pad according to claim 1, wherein the surface of the soft urethane sheet on which the opened pores are formed is embossed.

* * * * *